United States Patent [19]

Reddy

[11] 4,091,511

[45] May 30, 1978

[54] BAND TIGHTENING AND SECURING TOOL

[76] Inventor: Thomas J. Reddy, 3822 W. 133 St., Cleveland, Ohio 44111

[21] Appl. No.: 790,586

[22] Filed: Apr. 25, 1977

[51] Int. Cl.[2] ..... A43C 11/00

[52] U.S. Cl. ..... 24/273; 254/79; 24/68 D

[58] Field of Search ..... 24/68 R, 68 D, 19, 273; 254/51, 52, 79

[56] References Cited

U.S. PATENT DOCUMENTS

| | | | |
|---|---|---|---|
| 1,431,423 | 10/1922 | Reinboth | 254/79 |
| 2,208,114 | 7/1940 | Campbell | 24/68 D |
| 3,742,558 | 7/1973 | Lewis | 24/68 D |

*Primary Examiner*—Henry S. Jaudon
*Attorney, Agent, or Firm*—James Edison Carson

[57] ABSTRACT

A band tightening and securing tool has a rigid slide frame with parallel side slide rails connected at their forward ends by a transverse nose end portion flattened in the plane of the frame and at their rearward ends by a crossbar portion. A cross slide member bridging and slidable along the slide rails has a clamp arm mounted at one end on the cross slide between the slide rails and carrying at its other end a clamp device aligned with the longitudinal center line of the frame for tightly gripping and holding the free end portion of the band in a position extending lengthwise of the frame medially between its slide rails and flatwise across the flattened nose end of the frame.

10 Claims, 9 Drawing Figures

FIG.1
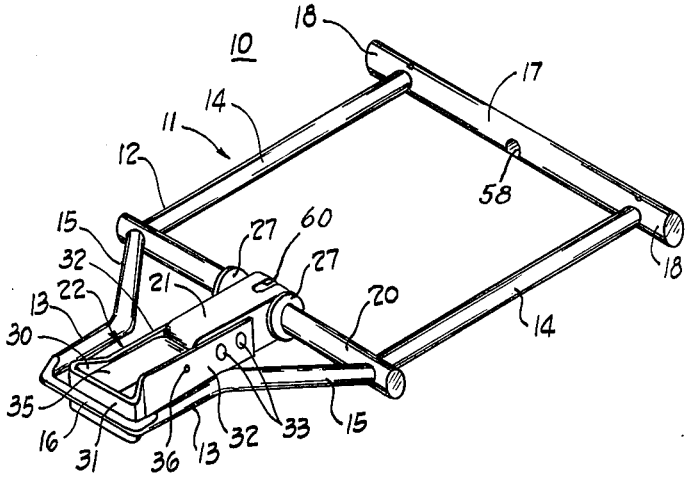
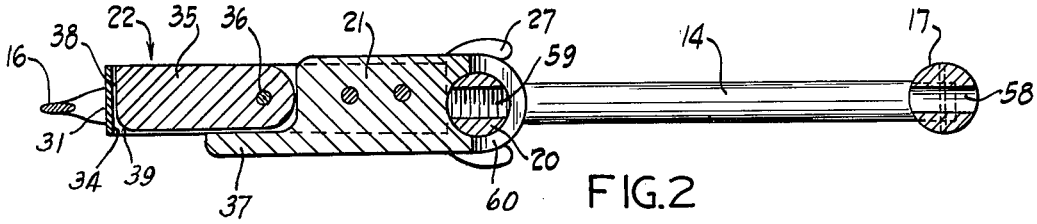
FIG.2
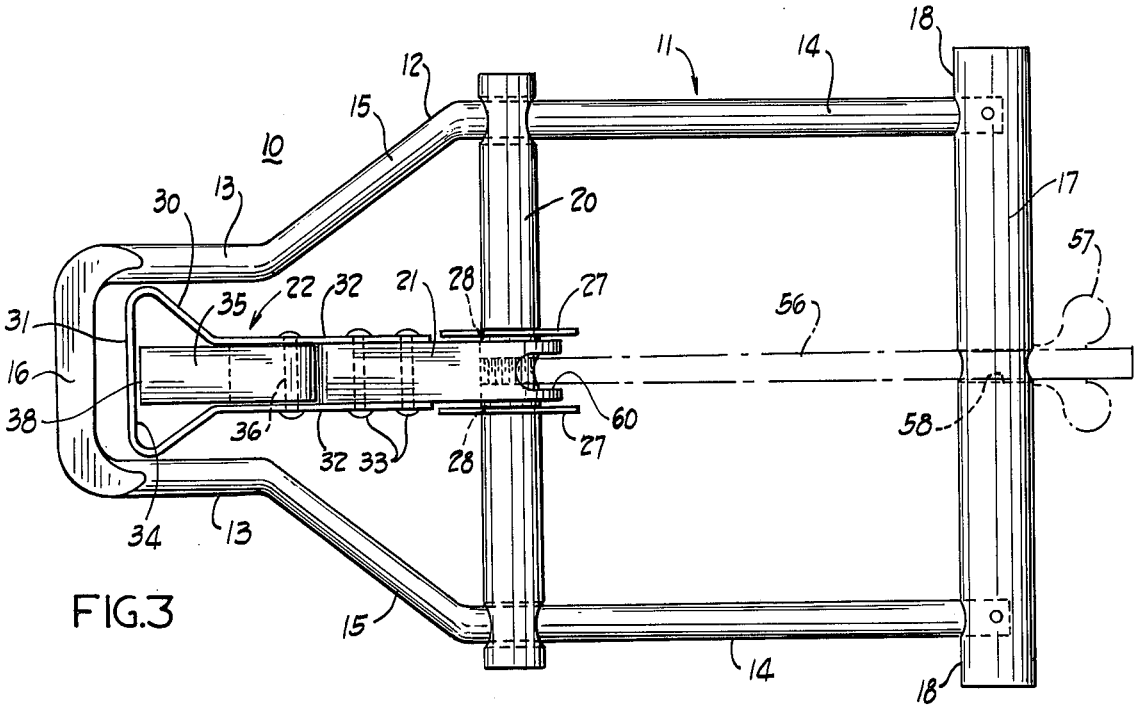
FIG.3

BAND TIGHTENING AND SECURING TOOL

BACKGROUND OF THE INVENTION (1) Field of the Invention

This invention relates in general to a banding tool for drawing and securing a metal band or strap tightly around an object such as, for example, the fiberglass or asbestos layer insulation commonly provided around pipelines, towers, vessels, tanks, and the like.

(2) Description of the Prior Art

It is common practice to provide an outer cover layer of fiberglass, asbestos, or other such blanket type insulation on various industrial and commercial pipelines, towers, vessels, tanks and the like, as for example, those employed in petrochemical and power generating facilities. For weather protection as well as appearance considerations, the blanket insulation is generally covered with a thin metal jacket layer of either aluminum, galvanized iron, or stainless steel. The blanket insulation, either with or without the protective outer metal jacket layer, is held tight in place around the pipeline or other vessel by means of a series of spaced metal bands or straps of aluminum, galvanized iron, or stainless steel. These bands are drawn tight around the insulation or metal jacketing and each locked in place in such tensioned state by a metal locking or fastening clip commonly referred to in the art as a wing seal and comprised of a shallow box-shaped section with a pair of upstanding locking lugs at one end.

In the application of the metal retaining bands around the layer insulation or its protective metal jacket layer where employed, each band is first secured at one end to its fastening clip by passage of the band end through the box-section of the clip from the end thereof opposite the locking lugs thereon and bending the inserted band end back tight around the bottom wall of the clip box-section. The band, together with its attached clip on one end, is then positioned or strung around the circumference of the insulation covered pipeline or other vessel and its other or free end passed through the box-section body portion of the fastening clip following which the band is then drawn or pulled tight around the pipeline or other vessel, by pulling forces applied to its opposite ends, and the free end of the band while thus tensioned then bent back over the top wall of the clip body section to secure the band in place in its tightened condition around the pipeline. After trimming off the excess length of the bent back free end of the band at a point a short distance beyond the locking lugs of the clip, the lugs are then bent down over the trimmed bent back free end of the band to lock it securely in place in the clip against any unwanted loosening therefrom, thus completing the band-applying operation.

The above described drawing or pulling of the metal band tight around the layer insulation or its protective metal jacketing on the pipeline or other vessel, and the bending back of the free end of the band over the top wall of the fastening clip, is customarily performed by the band applying workman with the use of a so-called banding tool. While various types of such banding tools have been heretofore available for the purpose, they have all possessed certain disadvantages such as their being of bulky and heavy form, expensive, and cumbersome and difficult to operate. Many of these tools are designed for use primarily by right-handed operators and thus are difficult to use by left-handed operators. Also, the most commonly used tools employed heretofore have generally incorporated a ratcheting mechanism for effecting the tightening of the metal band. These ratcheting mechanisms employ moving mechanical parts, e.g., the ratchet pawl, which eventually become worn so that the pawl slips and loses its grip on the metal band during usage of the tool, thus rendering the tool inoperative for its intended purpose. Such ratchet type tools also have the further disadvantage of being apt to cause the breakage of the metal band during the band tensioning and securing operation. This is so because the ratcheting mechanism, once it has been actuated to set the desired tension in the metal band, cannot be released in any way during the further course of the band applying operation to reduce or ease off on the added tension which develops in the band during the bending back of the free end of the band over the top of the fastening clip to secure it in place thereto, with the result that breakage of the band is likely to occur. In such case, repetition of the band applying operation is required, with attendant loss not only of the ruptured metal band material but loss of the workman's time as well.

The banding tools most commonly used in the past have also had the added disadvantage of limited capability in the angle to which they can bend the free end of the metal band back over the top wall of the fastening clip to secure it in place in the clip in its tensioned condition. These prior tools are able to bend back the free end of the metal band over the top wall of the fastening clip to an angle of only about 45° or so beyond perpendicularity, i.e., beyond a 90° bend. Such a limited angle bending back of the metal band over the fastening clip is insufficient, in most cases, to prevent the bent over free end of the band from being unbent and snapped back into the clip, and thus unloosened, by the pulling force of the tensioned band upon either the release of the metal band from the clamp jaws or other gripping means of the tool or upon the customary severing or cut-off of the excess portion of the bent over free end of the band at a point between the fastening clip and the band gripping means of the tool. When such unloosening of the metal band happens, it then becomes necessary for the workman to start the band tensioning and securing operation all over again, thus wasting work time and, in some instances, wasting the metal band material as well.

In an effort to avoid any such band unloosening occurrence resulting from the above described limited angle of bend over of the free end of the metal band, the workmen using these prior tools have been accustomed to applying finger pressure down on the bent over band end during the release of the band clamp jaws of the tool, or during the cut-off of the excess band material, in order to thereby maintain the bent over band end it its bent over band securing position until it can be subsequently bent down further to lie flat against the top of the fastening clip and then locked in place in the clip by the bending down of the locking lugs on the clip over the bent down end of the band. However, this procedure requires considerable skill and dexterity on the part of the workman to not only hold the heavy and cumbersome banding tool in place but to also simultaneously apply the necessary finger pressure to the bent over band end while at the same time either cutting off the excess band material or opeining the band clamp jaws of the tool to release the band. At best, this procedure constitutes a rather tricky and most difficult time-consuming operation, especially so in the case of a left-handed operator using a tool designed for use primarily by right-handed operators.

Of all the many drawbacks, however, of the prior band tightening and securing tools commonly employed in the past, perhaps the most troublesome and annoying one is their pronounced tendency to cause the clamped or otherwise gripped free end of the metal band to skew out of relative alignment with the tool and its clamp jaws or gripping means during the tensioning of the band by the tool. This skewing action of the metal band in the clamp jaws or gripping means of the tool is caused by the fact that these prior tools have been of the so-called side pull type wherein their band clamp jaws or gripping means are located at one side of the tool and offset from the longitudinal center line thereof so that the pulling forces exerted on the opposite ends of the band, during the band tensioning operation, are not in exact coalignment but instead are at a slight angle to one another. Because of this, and further because the clamp jaws or gripping means of these prior tools have been of the side opening type requiring sidewise slipping or insertion of the free end of the band into the clamp jaws or gripping means of the tool, the skewing action alluded to above results in the band working and slipping sideways out of the open side of the clamp jaws or gripping means during the band tensioning operation and so becoming completely disengaged therefrom and thus unloosened from around the pipeline or other vessel. Repetition of the band clamping and tightening operation is again necessitated, resulting in added lost working time by the band applying workman.

SUMMARY OF THE INVENTION

It is an object of the invention to provide a band tightening and securing tool which is of simple and light weight construction and easily manipulatable both by left and right-handed operators and which is free of all the above mentioned disadvantages of prior such tools.

Another object of the invention is to provide a band tensioning and securing tool which is comparatively easy and convenient to operate in all banding applications and which permits continuous adjustment of the tensioning force applied thereby to the band at all times throughout the band tightening and securing operation so that excessive tensioning and possible breakage of the band can be prevented.

Still another object of the invention is to provide a band tensioning and securing tool of center pull character such as operates to apply exactly coaligned pulling forces to the opposite ends of the band during the tensioning thereof by the tool and thereby avoids any concommitant skewing of the gripped end of the band sideways out of the clamp jaws or gripping means of the tool.

A further object of the invention is to provide a band tensioning and securing tool which is capable of bending back the free end of the band gripped therein to an angle over the top of the band fastening clip which is sufficient of itself to positively assure against the subsequent unbending and snapping back into the clip of the bent over free end of the band, with resultant unloosening of the band, by the pulling force of the tension in the band when it is either released from the band gripping means of the tool or cut off between the fastening clip and the gripping means.

A still further object of the invention is to provide a band tightening and securing tool which is capable of bending back the free end of the band gripped therein to an angle of nearly 180° over the top of the band fastening clip.

Another object of the invention is to provide a band tensioning and securing tool which is free of moving mechanical parts subject to wear that normally renders the tool inoperative and which permits the reuse of old metal bands that have been unloosened and removed from the pipeline or other vessel.

Briefly stated, in accordance with one aspect of the invention, a band tightening and securing tool is comprised of a rigid slide frame having side legs formed with parallel slide rail portions spaced apart a sufficient distance to accommodate an operator's hand therebetween and connected at their rearward ends by a crossbar portion serving as a handgrip and at their forward ends by a transverse nose end portion of relatively short length located centrally relative to the frame side legs and flattened in the plane of the frame. A cross-slide mounted on the slide rails for sliding movement therealong and serving as a complimentary handgrip to the crossbar handgrip has a clamp arm mounted at one end on the cross-slide between the slide rails and provided at its other end with a clamp device located medially between the side legs of the frame for tightly gripping and holding the free end portion of a metal band in a position extending lengthwise of the frame medially between its side legs and flatwise across the flattened nose end of the frame.

According to a further aspect of the invention, the clamp arm of the band tightening and securing tool is preferably pivoted at its one end on the cross-slide for pivotal movement in a plane normal to the plane of the frame to thereby enable the bending back of the clamped free end of the tensioned metal band over the top of the fastening clip to the maximum possible angle of nearly 180° so as to lie flat against the top wall of the clip and thus insure of itself the positive securing of the free band end in place in the clip against possible unloosening therefrom by the pulling force of the tensioned band upon release of the band end from the clamp jaws of the tool or cut-off of the excess band material at a point between the bend in the band over the clip and the clamp jaws of the tool.

Further objects and advantages of the invention will appear from the following detailed description of species thereof and from the accompanying drawings.

BRIEF DESCRIPTION OF THE DRAWINGS

In the drawings

FIG. 1 is a perspective view of a band tightening and securing tool comprising the invention.

FIG. 2 is a vertical section of the tool along the longitudinal center line thereof.

FIG. 3 is a plan view of the tool.

DESCRIPTION OF THE PREFERRED EMBODIMENTS

Figure 4:
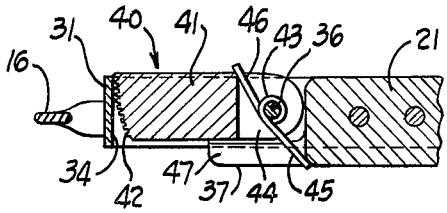
FIG. 4 is a fragmentary vertical section of a modified form of the band clamp means of the tool.

Referring to FIGS. 1–3 of the drawings, the band tightening and securing tool 10 according to the invention comprises a rigid metal frame 11 composed in part of a generally U-shaped bail member or slide bar portion 12 made of suitable material such as, for instance, steel rod or tubing of ¼ inch diameter or so, and having side legs 13 formed with parallel slide rail portions 14 spaced apart a sufficient distance to freely accommodate therebetween an operator's hand. From the slide rails 14, the side legs 13 of the bail or slide bar member 12 are symmetrically narrowed down, as indicated at 15, to a transverse bight portion 16 of relatively short length (e.g., 1½ inch or so) and centered on the longitudinal center line of the frame 11. The bight portion 16 is formed of relatively thin flat shape, e.g., around 1/16 to ⅛ inch or so thickness, in the plane of the frame 11 and serves as the front or nose end of the tool. At the rearward end of the frame 11, the side legs 13 of the bail or slide bar portion 12 are rigidly connected by a crossbar member 17 pinned or otherwise suitably fastened to the slide rails 14 and serving as one of the hand grips of the tool. The crossbar 17, which may be suitably made of steel or aluminum rod around ½ inch to ⅝ inch or so diameter, is preferably extended at each end outwardly beyond the slide rails 14 a short distance, as shown at 18, for use as a convenient hammer head by the workman during the band applying operation.

Figure 6:
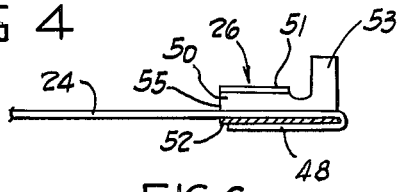
FIG. 6 is a vertical section through the clip shown in FIG. 5 with a metal band secured thereto at one of its ends.
Figure 7:
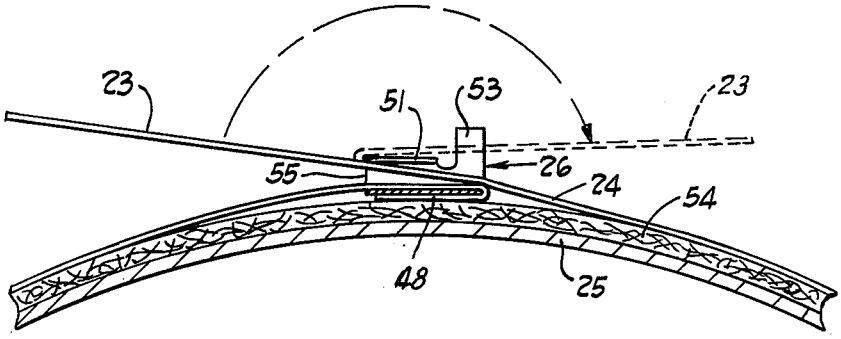
FIG. 7 is a fragmentary transverse sectional view through an insulated pipeline or other vessel with a metal retaining band positioned therearound and illustrating the manner in which the free end of the band is bent back over and secured in place to the fastening clip in its tensioned condition.
Figure 9:
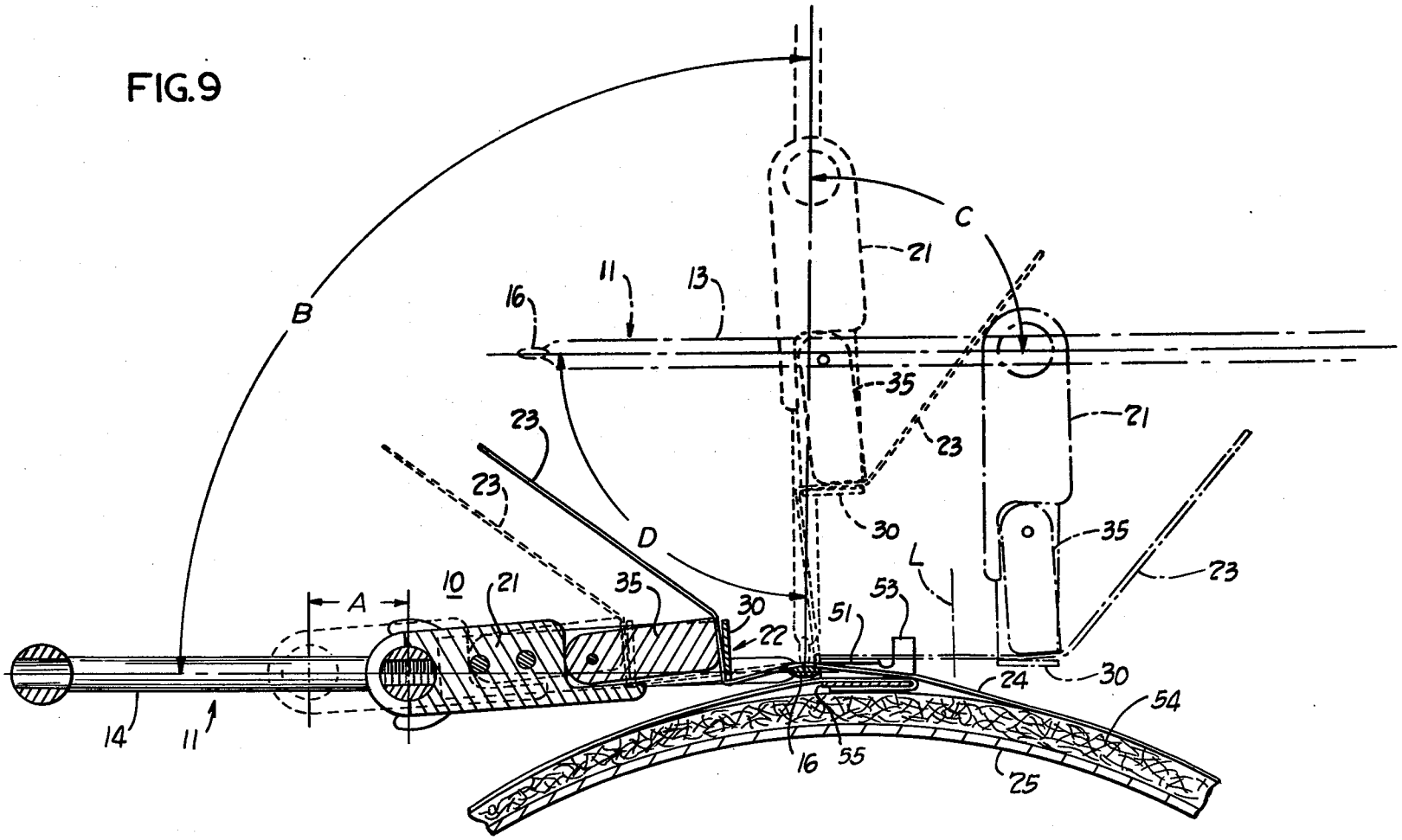
FIG. 9 is a view similar to FIG. 7 and showing the manner in which the band tightening and securing tool comprising the invention is employed to effect the tensioning and securing of the metal band in place around the pipeline or other vessel.

Slidably mounted on and bridging the slide rails 14 of the frame 11 for sliding movement therealong is a draw or cross slide member 20 which may be suitably made of steel rod around ½ inch to ⅝ inch or so in diameter and which serves as a hand grip complimentary to the crossbar hand grip 17. A clamp or draw arm 21, which may be suitably in the form of an elongated steel bar member, is mounted at one end on the cross slide 20 medially between the slide rails 14 of the frame 11. The clamp arm 21 may be fixedly secured in any suitable manner to the cross slide 20 so as to extend therefrom in a direction forwardly of the frame 11 toward the nose end 16 thereof. However, for more convenient and effective operation of the tool 10, the clamp arm 21 preferably is journaled at its one end on the cross slide 20 for pivotal movement in a plane normal to the plane of the frame 11. By being thus pivoted on the cross slide 20, the clamp or draw arm 21, which carries at its other or free end a suitable clamp device 22 for gripping and tightly holding the free end 23 (FIG. 7) of a metal band 24 to be applied around the pipeline 25 or other vessel, is then able to bend back the clamped free end 23 of the tensioned metal band 24 over the top of the band fastening clip 26 (FIGS. 5–7) to the maximum possible angle of nearly 180° so as to lie approximately flat against the top wall of the clip, as shown in FIGS. 7 and 9, thereby insuring of itself the positive securing of the free end of the band in place in the clip against possible unloosening therefrom upon its subsequent release from the clamp device 22 or its cut-off at a point between its bend over the clip and the clamp device. The pivoted clamp arm 21 is locked in place on the cross slide member 20 against sidewise movement out of its centered position thereon medially between the side legs 13 of the frame 11 in any suitable manner as, for example, by means of a pair of conventional snap type lock washers 27 which are snapped into respective annular grooves 28 (FIG. 3) in the cross slide member 20 at each side of the clamp arm 21.

The clamp means or clamp head device 22 provided on the free end of the clamp arm 21 is located centrally between the side legs 13 of the frame 11 and is constructed to fit freely between the narrowed down portion thereof, as shown in FIGS. 1 and 3. The clamp means is adapted to grip and hold the free end 23 of the metal band 24 flatwise therein and, in the starting position of the clamp or draw arm 21 as shown in FIG. 9, in a position extending flatwise across the top of the flat nose end 16 of the tool 10 in a direction longitudinally of the frame 11 and medially between its side legs 13. The particular clamp device 22 illustrated in FIGS. 1–3 comprises a stirrup-shaped clamping bar or plate member 30 suitably made of rigid, e.g., around 1/16 inch or so thickness, metal bar or strap material such as hardened steel, for instance, fixedly secured at its neck end to the free end of the clamp arm 21 in a position with its straight bight or saddle portion 31 disposed opposite the free end of the clamp arm 21 and extending crosswise of the slide frame 11 and its side legs 32 extending back alongside the opposite sides of the clamp arm 21 and suitably fastened securely thereto as by rivets 33, for example. The saddle portion 31 forms the fixed jaw of the clamp device 22 and its flat inward face 34 constitutes the gripping or clamping surface thereof. Although the saddle portion 31 of the clamping bar or plate member 30 may have its flat jaw face 34 disposed normal to the plane of the frame 11 when the clamp or draw arm 21 is positioned in the plane of the frame, as shown in FIG. 2, the jaw face 34 is preferably inclined upwardly and forwardly of the tool at a slight angle of around 5° or so with the clamp arm 21 thus positioned. The other or movable jaw of the clamp device 22 is constituted by a pivoted finger or pawl 35 suitably made of bar steel, for example, and pivoted at one end on the side legs 32 of the stirrup-shaped clamping bar 30, on a pivot pin 36, for pivotal movement in a plane normal to the saddle portion 31 of the clamping bar member 30. In its rest or inoperative position, as shown in FIG. 2, the clamp finger 35 extends longitudinally and forwardly of the clamp arm 21 from its pivot 36 and rests on an underlying lip extension 37 (FIG. 2) projecting forwardly from the free end of the clamp arm. The clamp finger or movable jaw 35 is formed with a squared off end 38 which serves as the jaw face thereof and which, in the rest position of the clamp arm 21, lies directly opposite and approximately parallel to the fixed jaw face 34 and spaced therefrom a slight distance of around 0.015 inch or so sufficient to just clear it when the clamp finger is pivoted upwardly to open the clamp jaws so as to permit insertion of the free end 23 of the metal band 24 therebetween but close enough to tightly clamp the commonly used metal bands, which generally range from 0.015 to 0.020 inch thickness, in place against the fixed jaw face 34 when the clamp finger is pivoted downwardly to close the jaws of the clamp device 22. Where the fixed jaw face 34 is inclined at a slight angle as described above, the jaw face 38 of the clamp finger 35 is in such case likewise inclined at a corresponding or slightly greater angle and so positioned relative to the fixed jaw face 34 as to cause the flat jaw face 38, or just its uppermost surface portion, to engage with the fixed jaw face 34 when the clamp finger 35 is in its rest position shown in FIG. 2. If desired, the jaw face 38 of the pivoted clamp finger 35 may be serrated or otherwise suitably roughened as illustrated at 42 in FIG. 4 in order to assure a more secure gripping and clamping of the metal band 24 in place in the clamp device 22. Also, the bottom edge of the jaw face 38 of the clamp finger 35 is preferably rounded off, as shown at 39 in FIG. 2, to further serve as a guide surface for guiding the free end 23 of the metal band 24 into position between the two jaw faces 34, 38 of the clamp device 22 during its insertion thereinto, thus facilitating this particular operation.

In the modified clamp device 40 shown in FIG. 4, the pivoted clamp finger 41 is in the form of an eccentric cam element having a serrated or otherwise roughened arcuate cam or jaw face 42 eccentrically centered relative to, i.e., centered above as viewed in FIG. 4, the pivot center of the clamp finger on the pivot pin 36 so that the high point of the cam-shaped jaw face 42 is located at its upper edge and engages, or nearly so engages, with the fixed flat jaw face 34 of the clamp device when the finger 41 is pivoted downwardly to close the cooperating jaw faces 34, 42. The clamp finger 41 is biased in a counter-clockwise direction, as viewed in FIG. 4, by means of a torsion coil spring 43 fitted over the pivot pin 36 and located within a slot-like recess 44 in the clamp finger and the opposite legs 45 and 46 of which respectively bear against the clamp arm 21 and the clamp finger 41, the spring leg 45 for such purpose extending through a slot 47 in the lip extension 37 on the clamp arm 21. Other equivalent biasing arrangements will be obvious to those skilled in the art. With the modified clamp device 40, as tension is applied to the metal band 24 clamped therein, the teeth or serrations on the eccentric cam jaw face 42 tend to bite further and further into the material of the band due to the downward pull of the tensioned band on the pivoted clamp finger 41 and resulting further downward pivoting thereof, thus automatically increasing or tightening the grip of the clamp jaw faces 34 and 42 on the band. The modified clamp device 40, with its more positive gripping action, is of particular utility in heavy duty banding applications involving the use of relatively large size heavy duty metal bands 24.

Figure 5:
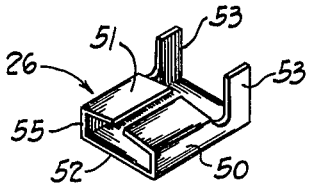
FIG. 5 is a perspective view of one of the fastening clips employed to secure the opposite ends of the metal band together.

Referring to FIG. 5, the metal fastening clip or wing seal 26 there illustrated and representative of the various types of clips with which the tool 10 of the invention is adapted to cooperate, is formed of either aluminum, galvanized iron, or stainless steel sheet material of approximately 1/32 inch or so thickness and comprises a shallow open-ended box section 50 with top and bottom walls 51 and 52, respectively, and a pair of side locking lugs 53 upstanding from the bottom wall 52 beyond the box section 50. The clip 26 is fastened to one end of the metal band 24 to be applied around the pipeline or other vessel in the manner shown in FIG. 6 by passing the band end through the box section 50 of the clip from the end thereof opposite the lugs 53 thereon and then bending the inserted band end tightly back around and under the bottom wall 52 of the clip, as shown at 48.

In the application of one of the metal bands 24 around the layer insulation 54 (FIG. 7) on a pipeline or other vessel 25, or around the protective metal jacketing thereon where employed, the metal band, with its attached fastening clip 26, is positioned or strung circumferentially around the insulation covered pipeline and the free end 23 of the band then passed through the box-section body portion 50 of the clip, in the manner shown in FIG. 7. Opposed pulling or tensioning forces are then applied to the opposite ends of the thus-positioned metal band 24 to draw it tight around the layer insulation 54 to the desired degree of tension whereupon the free end 23 of the metal band, while thus tensioned, is then bent back over the top wall 51 of the fastening clip 26 to an angle of nearly 180°, as shown in dotted lines in FIG. 7, to thereby secure it in place in the clip. After trimming or cutting off the excess length of the bent back free end 23 of the metal band 24, the locking lugs 53 on the fastening clip 26 are then bent down over the bent back and trimmed band end 23, in the manner shown in FIG. 8, to lock it securely in place in the clip, thereby completing the band applying operation. It is the procedure of drawing the metal band 24 tightly around the layer insulation 54 to the desired degree of tension and then bending back the free end 23 of the band over the top wall 51 of the fastening clip 26 to the nearly 180° angle that the tool 10 of the invention is designed to perform.

The manner of use of the tool 10 to perform the above described band tensioning and bending back operations is illustrated in FIG. 9. After the metal band 24 has been positioned around the layer insulation 54 on the pipeline or other vessel 25 and its free end 23 passed through the fastening clip 26, the tool 10 is then positioned with its nose end 16 underneath the free end 23 of the metal band and adjacent the front end 55 of the clip 26 and with the tool slide frame 11 in longitudinal alignment with the metal band, and with the clamp finger 21 of the tool so oriented as to swing outwardly away from the pipeline, i.e., upwardly as viewed in FIG. 9, when pivoted to open the clamp jaws 30, 35 of the clamp device 22. The free end 23 of the metal band 24 is then inserted into the opened jaws 30, 35 of the clamp device 22 from the underside thereof as viewed in FIG. 9 and then pulled hand tight therethrough while at the same time advancing the nose end 16 of the tool slide frame 11 into abutting engagement with the front end 55 of the fastening clip 26 and sliding the cross slide 20 forwardly to its approximately forwardmost position in the slide frame 11, as shown in solid lines in FIG. 9. While holding the free end 23 of the metal band 24 in its thus hand tightened position around the pipeline, the pivoted clamp finger 35 of the clamp device 22 is then swung and pressed downwardly by the operator to its closed position in engagement with the free end 23 of the metal band to thereby press it against the fixed jaw face 34 and so clamp it tightly in place in the clamp device, in readiness for the start of the final band tensioning operation. Then, while maintaining the nose end 16 of the tool 10 butted up against the front end 55 of the fastening clip 26, the cross slide 20 is pulled or drawn back in the slide frame 11 through the required distance A, by the operator gripping and pulling back on the cross slide while at the same time gripping in the same hand the frame crossbar portion 17, to thereby tighten and tension the metal band 24 to the desired degree around the pipeline. With the desired tension thus set in the metal band 24, the entire tool 10, using the bearing of its nose end 16 against the front end 55 of the fastening clip 26 as a fulcrum, is then swung outwardly away from the pipeline through an angle B of approximately 90°, as shown in dotted lines in FIG. 9, to bend the free end 23 of the metal band to a corresponding angle around the front edge of the top wall 51 of the fastening clip 26. Should the operator, during this initial bending of the free end 23 of the metal band, determine by his sense of feel that too much added tension is being applied to the metal band around the pipeline or other vessel 25 such as might cause the breakage thereof, the operator in such case can circumvent this condition from occurring simply by easing off a little on the manual pulling force being applied to the cross slide 20 so as to reduce the tension in the metal band 24 to the level at which possible breakage of the band is not apt to occur. In the same continuing motion, the clamp arm 21, while maintaining the tension in the metal band, is then bodily shifted in an arcuate path around the front edge of the clip top wall 51 through an arc C, to the position shown in dash-dot lines in FIG. 9, to thereby further bend the free end 23 of the metal band back over the top wall 51 of the fastening clip 26 through a total angle of nearly 180° from its original position so as to lie practically flat against the clip top wall 51 and thus positively secure it in place in the clip against subsequent unloosening therefrom. Simultaneously with the bodily shifting of the clamp arm 21 through the arc C, the slide bar frame 11 of the tool 10 is further pivoted in a forward direction to cause the nose end 16 thereof to swing backwardly out of the way of the fastening clip 26 through an angle of around 90° or so, as indicated generally by the arc D in FIG. 9.

Figure 8:
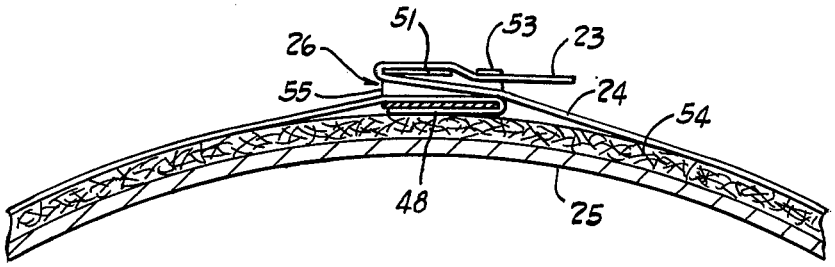
FIG. 8 is a view similar to FIG. 7 but showing the locking lugs of the fastening clip bend down over the bent back free end of the metal band to lock it in place in the clip and complete the band applying operation.

Upon completion of the step of bending the free end 23 of the metal band back over the fastening clip 26, as described above, the clamp finger 35 is pivoted open to release the band end 23 from the clamp device 22 following which the excess length of the band end is suitably trimmed or cut off, as by the use of a conventional tin snips for example, at a point a short distance beyond the locking lugs 53 on the fastening clip, as indicated at L in FIG. 9, and the locking lugs then bent down over the bent back trimmed end 23 of the metal band, in the manner shown in FIG. 8, to effectively lock it in place in the fastening clip against unwanted unloosening therefrom and so complete the band applying operation. The bending down of the locking lugs 53 over the bent back band end 23 may be conveniently accomplished by employing one or the other of the projecting outer ends 18 of the frame crossbar portion 17 as a hammer head to hammer or press down the lugs over the band end.

In certain applications such as those involving the application of large size heavy duty metal bands 24 around the pipeline or other vessel 25, it may be desirable to apply a greater degree of tension to the metal band than can be applied by the operator's hand grip force alone on the cross slide 20. In such case, a so-called mechanical advantage device in the form of a tensioning screw bolt 56 (FIG. 3) provided with a tightening wing nut 57 screw-threaded thereon can be utilized to apply the necessary added pulling force to the cross slide 20 to produce the desired higher degree of tension in the metal band 24. The screw bolt 56 is inserted and slid through a central bore opening 58 in the crossbar 17 and screwed into a threaded central bore opening 59 (FIG. 2) in the cross slide 20 to secure the screw bolt thereto. The wing nut 57 is then screwed onto the back end of the screw bolt 56 projecting rearwardly from the crossbar 17 until it engages with the crossbar. Continued turning of the wing nut 57 to tighten it against the crossbar 17 then acts to pull the cross slide 20 rearwardly in the slide bar frame 11 and so apply the tension to the metal band 24 gripped in the clamp device 22 of the tool 10. To permit pivotal movement of the clamp arm 21 on the cross slide 20 when the screw bolt 56 is employed, the clamp arm is provided with a slot-shaped opening or cross slot 60 in its rearward end within which the screw bolt is accommodated when the clamp arm is pivoted on the cross slide. The cross slot 60 is of sufficient arcuate extent around the pivot center of the clamp or drawn arm 21 on the cross slide 20 to permit up to at least 90° or so of pivotal movement of the clamp arm on the cross slide in each direction from its centered position in the plane of the frame 11.

Because of the centered pull form of the band applying tool 10 according to the invention wherein its band clamping jaws 30, 35 are located on the longitudinal center line of the tool and its draw slide 20 so that the pulling or tensioning forces applied by the tool to the opposite ends of the metal band 24 are in parallel alignment with one another, there is no tendency for the clamped free end 23 of the metal band to skew or work laterally out of alignment with the center line of the tool during the band tensioning operation and so become disengaged from the clamp jaws 30, 35 such as occurs with the prior type band applying tools commonly used heretofore. Also, because the tool 10 is able to bend back the free end 23 of the metal band 24 over the fastening clip 26 to an angle of nearly 180°, positive securing of the bent over band end 23 in place in the clip 26 is therefore assured so that the bent over band end then can be either released from the band clamping jaws 30, 35 of the tool, or trimmed off between the fastening clip 26 and the clamping jaws, without any likelihood whatever at that time of the bent over band end 23 being unbent and snapped back into and through the body portion 50 of the fastening clip, by the tension force of the tensioned metal band 24, to cause the unloosening of the metal band from its tensioned condition around the pipeline or other vessel 25.

The feature possessed by the tool 10 of the invention of enabling the backing or easing off on the added tension developed in the metal band 24 during the bending of its free end 23 over the fastening clip 26, whereby excessive tensioning and resulting possible breakage of the metal band can be avoided, is a novel characteristic that, so far as known, has not been afforded by any of the prior banding tools. Moreover, because the clamping jaws 31, 35 of the tool 10 can be advanced forwardly in the frame 11 to a position where they lie immediately contiguous the nose end 16 of the frame, as limited only by the engagement of the fixed jaw or saddle portion 34 of the clamp device 22 with the nose end 16 of the frame, only a comparatively short length of the metal band 24 needs to project from the fastening clip 26, to form the free band end 23 (FIG. 7), for the tool 10 to be able to grip and clamp the free band end 23 in its clamp device 22. As a result, the tool 10 comprising the invention, unlike any prior banding tool so far as known, is capable of applying and thus reusing so-called old metal bands 24 that have been removed from previous installations, by unloosening them from their metal fastening clips 26, without the need of having to splice such old bands together or to an additional length of band stock such as has been required in the past in order to provide a free band end 23 projecting from the clip 26 of sufficient length to permit it to be clamped or gripped in place in such prior banding tools.

What I claim as new and desire to secure by Letters Patent of the United States is:

1. A band tightening and securing tool comprising a rigid metal frame comprised of a U-shaped bail section having side leg portions extending back from a forward bight portion of relatively short linear extent and flattened in the plane of said frame to constitute the nose end of the tool, said side leg portions having parallel slide rail portions spaced apart a sufficient distance to receive therebetween an operator's hand, and a cross section bridging and tying together the said side leg portions adjacent their rearmost terminal ends, a cross slide member bridging and slidably mounted on the said slide rail portions of said frame for sliding movement therealong, a band clamping draw arm extending forwardly from said slide member medially of the said spaced slide rail portions of the frame and toward the said nose end thereof, and a band clamp head on the forward end of said draw arm for clamping therein a free end portion of the band so as to hold the band in a position extending longitudinally of the frame medially between its said side leg portions and flatwise across the said flattened nose end of the frame.

2. A band tightening and securing tool as specified in claim 1 wherein the said draw arm is pivotally mounted on said cross slide member medially of the side leg portions of said frame for pivotal movement in a plane normal to the plane of said frame.

3. A band tightening and securing tool as specified in claim 1 wherein the said draw arm comprises an elongated bar member extending from said slide member and said band clamp head comprises a stirrup-shaped rigid strap member having its side legs disposed on opposite sides of and fixedly secured to said bar member in a position extending lengthwise thereof and its saddle portion disposed opposite and extending transversely across the free end of the bar member in spaced relation thereto to form the fixed jaw of the clamp head, and a clamp finger disposed between and pivotally mounted at one end on the said side legs of said stirrup member to pivot in a plane normal to the said saddle portion of said stirrup member to form the movable jaw of the clamp head, the other end of said finger constituting the jaw face thereof and being adapted to cooperate with the said fixed jaw to clamp a band therebetween when pivoted to its closed position.

4. A band tightening and securing tool as specified in claim 3 wherein the said draw arm is pivotally mounted on said cross slide member medially of the side leg portions of said frame for pivotal movement in a plane normal to the plane of said frame.

5. A band tightening and securing tool as specified in claim 3 wherein the said stirrup member is of shorter transverse dimension than the spacing between the said side legs of said frame to thereby permit forward movement of the slide member in said frame to a position wherein the said saddle portion of the stirrup member is located immediately contiguous the said nose end of the frame.

6. A band tightening and securing tool as specified in claim 4 wherein the said bar member has a forwardly extending lip underlying and against which the said pivoted clamp finger engages to locate it in a rest position with its said jaw face end directly opposite the flat inward jaw face of the saddle portion of said stirrup member.

7. A band tightening and securing tool as specified in claim 6 wherein the saddle portion of said stirrup member, in its position in the plane of said frame, has its flat inward jaw face disposed approximately normal to the plane of said frame and said clamp finger has its said jaw face end disposed so as to lie approximately parallel to the said inward jaw face of the saddle portion of said stirrup member when the clamp finger is in its said rest position.

8. A band tightening and securing tool as specified in claim 6 wherein the saddle portion of said stirrup member, in its position in the plane of said frame, has its flat inward jaw face sloped upwardly and forwardly of said frame at an angle of a few degrees and said clamp finger has its said jaw face end correspondingly sloped so as to be disposed approximately parallel to the said inward jaw face of the saddle portion of said stirrup member when the clamp finger is in its said rest position.

9. A band tightening and securing tool as specified in claim 1 wherein said crossbar section and said cross slide and draw arm members are provided with aligned bore openings located medially between the said slide rail portions of the frame for receiving a threaded tensioning bolt therein, the bore opening in said cross slide member being threaded for screw threading of an end of the tensioning bolt therein, said tensioning bolt being freely slidable through the bore opening in said crossbar section and being provided with a tightening nut screw threaded onto the other end portion of the bolt projecting outwardly from said crossbar section.

10. A band tightening and securing tool as specified in claim 2 wherein said crossbar section and said cross slide member are provided with aligned bore openings located medially between the said slide rail portions of the frame for receiving a threaded tensioning bolt therein, the bore opening in said cross slide member being threaded for screw threading of an end of the tensioning bolt therein, said tensioning bolt being freely slidable through the bore opening in said crossbar section and being provided with a tightening nut screw threaded onto the other end portion of the bolt projecting outwardly from said crossbar section, and said draw arm being provided with a cross slot in its rearwardly facing end for insertion of the said tensioning bolt therethrough and accommodating it therein when the draw arm is pivoted on said cross slide member, said cross slot being of sufficient arcuate extent around the pivot center of the draw arm on the cross slide member to permit up to at least 90° or so if pivotal movement of the draw arm on the cross slide in each direction from its centered position in the plane of said frame.

* * * * *